US005829674A

United States Patent [19]

Vanostrand et al.

[11] Patent Number: 5,829,674

[45] Date of Patent: Nov. 3, 1998

[54] ZONE SYSTEM CONTROL

[75] Inventors: William F. Vanostrand, Indianapolis, Ind.; Laurie L. Werbowsky, Jamesville, N.Y.; Michael A. Roher, Wayne, Ind.

[73] Assignee: Carrier Corporation, Syracuse, N.Y.

[21] Appl. No.: 931,075

[22] Filed: Sep. 15, 1997

Related U.S. Application Data

[60] Provisional application No. 60/045,417 May 2, 1997.

[51] Int. Cl.[6] ..... F24F 7/00; F24F 3/14

[52] U.S. Cl. ..... 236/49.3; 165/208; 165/217

[58] Field of Search ..... 236/49.3, 51, 78 D; 165/217, 208, 209

[56] References Cited

U.S. PATENT DOCUMENTS 5,344,069 9/1994 Narikiyo ..... 165/217 X 5,348,078 9/1994 Duchane et al. ..... 236/51 X 5,415,346 5/1995 Bishop ..... 236/78

*Primary Examiner*—William Wayner

[57] ABSTRACT

A device and method for controlling the conditioning of air in the zones of a forced air HVAC system. The device comprises thermostats located in at least two different zones, air ducts and dampers located therein to control the flow of air to the different zones. The microprocessor receives signals from the thermostats corresponding to perceived temperatures in the zones and compares the perceived temperatures to predetermined temperatures and determines a trajectory for each of the zones. The microprocessor in turn sends signals to the dampers corresponding to a positions between fully open and fully closed to control the amount of conditioned air through the ducts such that each of the zones follows the trajectory and reaches the predetermined temperatures at about the same time. The microprocessor further determines system demand and turns the HVAC system on and off in response to the system demand.

13 Claims, 1 Drawing Sheet

ZONE SYSTEM CONTROL

This application claims the benefit of U.S. Provisional Application No. 60/045417 filed May 2, 1997.

TECHNICAL FIELD

This invention relates to zone control of a building HVAC system and in particular to the means by which dampers are positioned and to the means by which the heating and cooling equipment is turned on and off.

BACKGROUND ART

Zoning systems for controlling an HVAC system use input signals from sensors located within different zones of a dwelling to determine either cooling or heating demand for a particular zone relative to a temperature set point. The zoning systems utilize the input signals to generate signals to either open or close dampers to control the air flow from the HVAC system to the respective zones and thereby controlling the temperature of the zone. Zoning systems in the past have been one of two types, modulating or non-modulating. The simplest is the non-modulating. In a zone where there is a demand, its damper opens fully. When the demand goes to zero, the damper closes fully. This type of system has no ability to position the dampers in intermediate positions.

A modulating system has the capability to position its dampers to intermediate positions between fully closed and fully open. A control algorithm determines the position for each damper, modifying this position on a regular basis while the equipment operates. This type of system is more complex and costly, but can provide better control of zone temperatures.

Modulating systems in the past have controlled their damper positions based on the magnitude of the demand, for instance the difference between the set point and the actual zone temperature, in each zone. The zone with the largest demand has the most open damper.

The general controlling rules are:

1) The zone with the largest demand should have the most open damper.
2) When a zone's demand reaches zero, its damper should be closed.

An additional requirement is that at least one zone must be fully open when the equipment is operating. This is because the equipment itself must have a certain minimum air flow through it for proper operation. It will not operate properly with all dampers closed.

This approach results in dampers being maximally open at the start of a cycle, because demand is greatest then, with dampers progressively closing during a cycle until a single damper is left open just before the equipment turns off.

Within the area of HVAC systems the term equipment control is used to denote the tuning on and off of the heating or cooling equipment by the zoning system. If multi-stage equipment is involved, then this term includes the turning on and off of all the available equipment stages.

Most zoning systems, both modulating and non-modulating use the following rules for equipment control:

1) When the greatest zone demand exceeds a preset value, the equipment is turned on.
2) When the greatest zone demand becomes zero, the equipment is turned off.

If multi-stage equipment is used, higher stages are generally turned on by larger demands than that needed to turn on the first stage.

In addition to these rules, there are cycle timers which limit the number of cycles per hour and staging timers which limit staging advancement in multi-stage systems, but these do not differ appreciably between the previous and the new control strategy.

DISCLOSURE OF THE INVENTION

The damper positioning system of the present invention employs a single and unique set of damper positions consisting of one zone fully open and all others each partially opened which will result in the demand in all zones going to zero at the same time. If this set of positions is preset at the start of an equipment cycle, the dampers will not have to move at all during the cycle. The equipment can be turned off when all the deviations from the temperature set points in all zones are zero.

The present invention chooses a unique set of damper positions using a two part solution. The first is to select the optimum starting positions of each of the dampers at the beginning of an equipment cycle and the second is to actively trim these positions during the cycle to converge at zero the demand in all zones at the same time to end the cycle. The control algorithm of the present invention implements both of these in an effective manner.

DETAILED DESCRIPTION OF THE INVENTION

Figure 1:
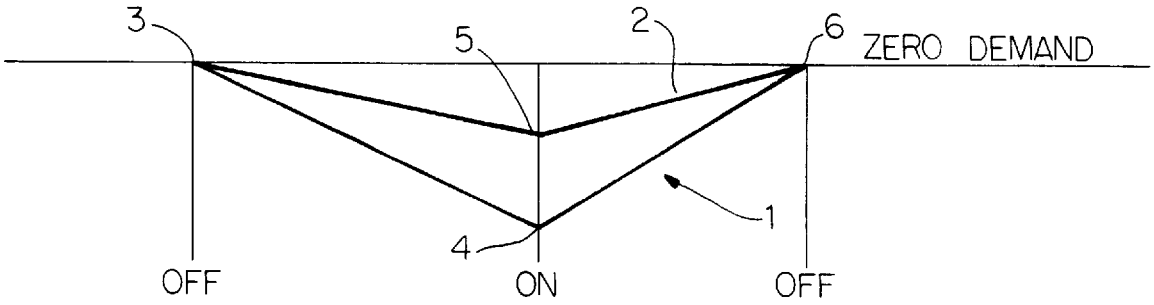
FIG. 1 is a graphical representation of the control system of the present invention.

The underlying assumption used in prior zoning systems that the zones with the largest demands should have the most open dampers is not necessarily correct. Many HVAC installations are comprised of combinations of zone loss and size, duct sizing and duct length. These combinations create situations where the zone with the largest demand will not require a fully open damper to arrive at zero demand with the other zones. Likewise there will exist zones which do not have the largest demand at the start of a cycle but which need to be fully open in order properly satisfy the demand. The control system of the present invention positions the dampers optimally to allow all of the zones to approach zero demand at the same time.

A chronic problem in zoning systems is that of air noise. Most zoning systems operate by restricting ducts. These systems force higher air flows in some ducts which in turn increases air noise. Earlier systems which start a cycle with the duct system fully open and then progressively close dampers as the cycle progresses are quiet at the beginning of a cycle and become progressively more noisy toward the end of the cycle. This can be annoying to the home owner. This type of system puts stress on the equipment, particularly furnaces, because as airflow is reduced toward the end of the cycle, thermal stresses increase and over time can reduce life of the furnace. The control system of the present invention works to keep air flow as constant as possible over an equipment cycle with resultant benefits of constant and reduced noise levels as well as diminished stress on the equipment. An additional benefit of constant air flow is that air temperatures within the ducts tend to remain constant which contributes positively to occupant comfort. The present invention also holds advantages over systems employing constant air flow blowers. In systems employing constant air flow blowers the noise problem can actually become aggravated by a constant air flow blower because the air flow does not decrease when the duct system becomes more restricted.

Under circumstances where the equipment is not capable of satisfying the demand, for example the use of a small air conditioner on a very hot day, many prior art systems will fully open all dampers when the demand becomes large enough. The result is that substantive zoning disappears and the demands in each zone can grow unequally. In circumstances where the HVAC system cannot satisfy demand the control system of the present invention continues to modulate dampers to keep demands in all zones equal. This results in increased occupant comfort because all zones are kept at the same demand value, even under overload conditions.

The control system of the present invention is able to modify HVAC damper positions during a long cycle to drive all zones to reach zero demand at the same time. Some equipment types, a large furnace for example, will in most circumstances drive demand to zero in a matter of minutes. Other types, a heat pump in cold weather for example, will under certain conditions run for days without turning off. Both of the above mentioned situations illustrate that the actual demand of zone and the ideal demand of the zone may differ greatly and that in reality it may not be physically possible to drive the demand in all zones to zero at the same time. The control system of the present invention takes these practical problems into account in determining the optimal control of the HVAC equipment.

Referring to FIG. 1 there is shown a graphical representation of the present invention for a 2 zone heating system. The horizontal axis represents time and the vertical axis represents the heating or cooling demand for an HVAC system employing the control system of the present invention. Line 1 is a graphical representation of the ideal demand for a zone 1 and line 2 is a graphical representation of the ideal demand for a zone 2. Point 3 represents the temperature set point and a moment in time wherein zone 1 and zone 2 both have zero demand and the HVAC system is not operating. Points 4, 5 correspond to the maximum demand for zones 1 and 2 respectfully. Point 6 corresponds to the temperature set point and a moment in time when both zone 1 and zone 2 both have zero demand and the system is again not operating. Between point 3 and points 4,5 the HVAC equipment is not operating and the demands grow unequally in each zone until they are large enough for the equipment to turn on. The HVAC equipment is turned on as result of the demand represented by point 4. When the equipment is operating the actual demand in each zone serves as the starting point for a trajectory, or a calculated path of time versus demand to drive each zone to zero demand. The trajectory for zone 1 is depicted by that portion of line one that lies between point 4 and point 6. The trajectory for zone 2 is depicted by that portion of line 2 that lies between point 5 and point 6. This determination of the trajectories continues until all demands reach zero at the same time. The equipment then turns off and the cycle repeats itself.

Figure 2:
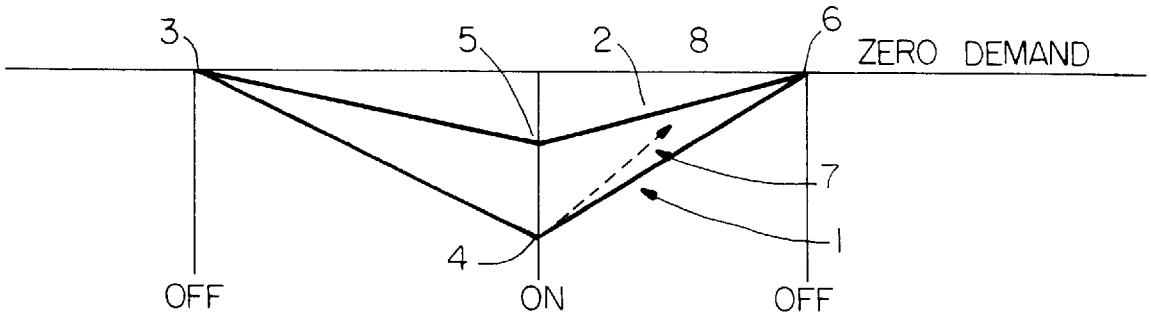
FIG. 2 is a graphical representation of the control system of the present invention.
Figure 3:
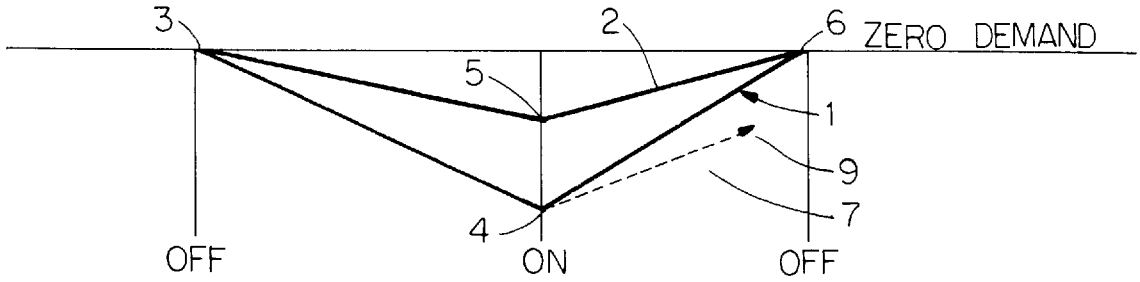
FIG. 3 is a graphical representation of the control system of the present invention.

The control algorithm of the present invention calculates the ideal trajectory for each zone at a predetermined time interval. In a preferred embodiment this time interval is approximately 2 minutes. At the same time interval a deviation is calculated which is equal to the difference between the actual zone temperature and the ideal trajectory. The deviation value for each zone is used to produce an incremental change to the damper position for each respective zone. The change in damper position acts to drive the actual zone demand into correspondence with the trajectory. Referring to FIG. 2, line 7 represents the actual demand of zone 1. The difference between the value at a point along line 1 and the value at a point corresponding to the same time along line 7 represents the deviation that is used in the algorithm of the present invention to determine the optimal positioning of multiple dampers. In the example illustrated in FIG. 2 the deviation shown at point 8 corresponds to the zone 1 temperature being driven ahead of its calculated trajectory. If this condition is allowed to continue the temperature in zone 1 will converge on its set point too quickly. The control system of the present invention the damper will close the damper for zone 1 slightly to reduce the flow of air into zone 1. Referring to FIG. 3, line 7 again represents the actual demand of zone 1. In this particular example the deviation shown indicates that the actual demand of zone 1 is behind the trajectory calculated for that zone. In this situation the control system of the present invention will open the damper for zone 1 slightly to increase the flow of air into zone 1. The control system of the present invention continues to monitor the deviation between the actual demand of the zone and the ideal demand of the zone and adjust damper positions accordingly to drive the zone to the calculated trajectory. When the deviation is zero, the zone is exactly on course with respect to the calculated trajectory and no change in damper position is needed.

In order to calculate the trajectory for a given zone the progress of the entire system from its initial turn on point to its turn off point must be known. The system progress is expressed mathematically in equation 1.

(1) system progress=(sum of demands at present time)/(sum of demands at start of cycle)

The assumption used is that the sum of all demands as they change with respect to time is an accurate measure of the progress the system is making toward its goal of zero demands. When HVAC equipment is initially turned on there is a delay before conditioning of the zones is actually available. This delay may be caused by furnace warm up time for instance. During this delay demands will increase and the value of system progress will become greater than unity. In other words the system will fall further behind demand while the delay is experienced. The system progress equation presented is still valid and the control of the system dampers is still optimum under these conditions.

For each zone, the trajectory is calculated by multiplying the system progress by the initial demand for that zone, and is expressed mathematically in equation 2.

(2) trajectory of zone n=(system progress)×(initial demand in zone n)

The objective of this portion of the present invention is that each zone ideally should progress from its starting demand toward zero demand concurrently with all other zones. To ensure that each zone is progressing towards its set point concurrently with all other zones the percent progress toward respective set points is monitored.

The deviation for each zone is the difference between its actual temperature and its trajectory. The deviation for each zone is mathematically stated in equation 3.

(3) deviation of zone n = (sum of demands at present time)/(sum of demands at start of cycle) × (initial demand in zone n) − (set point of zone n) + (temperature of zone n)

Once the deviation for each zone is calculated, the value is the input to a conventional proportional plus integral (PI)

control loop which calculates the actual damper position for each zone. A signal is then sent to the individual dampers to adjust their position.

To establish the best starting position for each damper at the start of a cycle, some form of best guess for each damper must be made. An embodiment of the present invention uses a time weighted average of actual damper positions during past recent time of equipment operation. For example, every 2 minutes of equipment operation the weighted average of actual damper position is recalculated. At the start of a cycle, this calculated average position is used to preposition each damper. For an embodiment of the present invention this is stated mathematically in equation 4.

(4) new average position (alpha)×(old average position)+(1—alpha)×new position where alpha=⅛ and (1—alpha)=⅞

This is a common first order digital filter calculation. The alpha term determines the time weighting of the filter and in an embodiment is set to provide a time constant of about 16 minutes of operation. Stated more simply, each damper starting position at the beginning of every equipment cycle is approximately the average position of that damper over the past 16 minutes of equipment operation. The underlying assumption is that the best guess for a starting damper position is that which existed during past recent equipment operation.

Another objective of the present invention is to satisfy the requirement that at least one damper must be fully open to prevent damage to the HVAC system. This objective is met by requiring that:

1) If no damper calculates at or greater than fully open, add an equal amount of damper opening to all dampers such that the most open becomes fully open. and,
2) Any damper which calculates to more than fully open will be made fully open.

The control system of the present invention also calculates a system demand value. The system demand value is the average of two values. One value is the average demand of all zones which have demand, and the other is the greatest demand. This is stated mathematically in equation 5.

(5) system demand value=[(sum of zone demands)/(number of zones with demand)+(greatest zone demand)]/2

This reduces to a single zone demand when only one zone has demand, or as stated mathematically in equation 5.1.

(5.1) system demand value=greatest zone demand

The system demand value is equal to the demand value of each zone when all zones have equal demand. This value is independent of the number of zones and is stated mathematically in equation 5.2.

(5.2) system demand value=zone demand value

When the system demand value exceeds a preset constant the HVAC system is turned on, subject to the timing constraints mentioned above, to meet the demand requirements. When system demand value is zero the HVAC system is turned off or remains off. Therefore, from the above, if all zones have equal demands, the equipment will be turned on at the same demand value regardless of the number of zones, and will turn off when the demands go to zero.

During an equipment cycle, all zone demands diminish but will not arrive at zero at exactly the same time. When the HVAC system is turned off some zones may have small positive demands, not reaching the demanded level of conditioning. Other zones may have a small negative demand, slightly over conditioned relative to their demand level, sometimes referred to as overshoot. The zone with the largest demand at turn off will be balanced by an offsetting amount of overshoot in other zones and this overshoot will be greater than the unsatisfied demand, due to the unequal weighting of the greatest demand in the system demand equation. This result, although small, contributes to greater comfort for the homeowner.

Under certain conditions the dampers will be set at their limits, with some dampers being fully open and others dampers being fully closed, and the HVAC system will not be capable of driving all of the zones to their set points at the same time. This is a very common problem in trying to cool two story homes. The lower story becomes severely overcooled while the equipment remains operating, trying to satisfy the top story. Under these circumstances the control system of the present invention will divide the over conditioning and under conditioning rather than ignore the over conditioned zones while attempting to satisfy the under conditioned zones. Referring back to equation 5 it can be seen that the present invention uses a weighted averaging scheme to accommodate these conditions. The averaging is weighted in the direction of over conditioning because slight overconditioning is generally more acceptable than slight underconditioning.

While the invention has been particularly shown and described with reference to a preferred embodiment thereof, it will be understood that various changes in form and details may be made therein without departing from the spirit and scope of the invention.

What is claimed is:

1. A control device for controlling an HVAC system, the HVAC system having an on cycle and an off cycle, at least two zones for conditioning the air in the least two enclosed spaces between a start temperature and a predetermined temperature, the control device comprising:

a control mechanism for each of the at least two zones operably connected to the HVAC system and capable of controlling the amount of conditioning to each zone between a fully open position and a fully closed position;

a temperature sensor capable of perceiving the temperature in the enclosed space of the at least two zones and capable of providing a signal corresponding to the perceived temperature;

a microprocessor operatively connected to receive the signals from the temperature sensors for comparing the perceived temperature to the predetermined temperature;

the microprocessor operative to determine a demand for each of the at least two zones and a trajectory between the start temperature and the predetermined temperature for each of the at least two zones; and the microprocessor further operative to send a separate signal to each of the at least two control mechanisms corresponding to a position between fully opened and fully closed such that the temperature of each of the at least two zones follows the trajectory and such that each of the at least two zones reaches the predetermined temperature at about the same time.

2. A control device according to claim 1 wherein one of the at least two dampers is positioned in the fully open position.

3. A control device according to claim 1 wherein the sensors send a signal to the microprocessor at a predetermined time interval.

4. A control device according to claim 1 including a starting position for the dampers wherein the starting position is determined by a time weighted average of the position of the dampers during a previous on cycle of the HVAC system.

5. A control device according to claim 1 wherein the trajectory for each of the at least two zones is determined at a predetermined time interval by comparing the demands of each of the at least two zones with the demands of the at least two zones at the start temperature.

6. A control device for controlling an HVAC system, the HVAC system having an on cycle and an off cycle, a fan, at least two zones for conditioning the air in the least two enclosed spaces between a start temperature and a predetermined temperature, the at least two zones comprised of separate air ducts positioned to receive air from the fan and deliver to the enclosed spaces, the control device comprising:

a damper disposed within each of the at least two separate air ducts variably operable between a fully open position and a fully closed position;

a temperature sensor capable of perceiving the temperature in the enclosed space of the at least two zones and capable of providing a signal corresponding to the perceived temperature;

a microprocessor operatively connected to receive the signals from the temperature sensors for comparing the perceived temperature to the predetermined temperature;

the microprocessor operative to determine a demand for each of the at least two zones and a trajectory between the start temperature and the predetermined temperature for each of the at least two zones; and the microprocessor further operative to send a separate signal to each of the at least two dampers corresponding to a position between fully opened and fully closed such that the temperature of each of the at least two zones follows the trajectory and such that each of the at least two zones reaches the predetermined temperature at about the same time.

7. A control device according to claim 6 wherein one of the at least two control mechanisms is positioned in the fully open position.

8. A control device according to claim 6 wherein the sensors send a signal to the microprocessor at a predetermined time interval.

9. A control device according to claim 6 including a starting position for the control mechanism wherein the starting position is determined by a time weighted average of the position of the dampers during a previous on cycle of the HVAC system.

10. A control device according to claim 6 wherein the trajectory for each of the at least two zones is determined at a predetermined time interval by comparing the demands of each of the at least two zones with the demands of the at least two zones at the start temperature.

11. A method of controlling an HVAC system, the HVAC system having a fan, at least two zones for conditioning the air of at least two enclosed spaces, the at least two zones comprised of separate air ducts positioned to receive air from the fan and deliver to the enclosed spaces, the method comprising the steps of:

setting the dampers at a predetermined start position;

sensing the temperature in the enclosed space;

comparing the sensed temperature with a desired temperature; and controlling the positions of the dampers between fully open and fully closed to cause the temperature of the enclosed space of each of the at least two zones to reach the desired temperature at about the same time.

12. The method according to claim 11 wherein the setting step includes the step of determining the start position by a time weighted average of the position of the dampers during a previous on cycle of the HVAC system.

13. A method according to claim 11 the method further comprising:

the comparing step includes the step of calculating a trajectory for each of the at least two zones; and the controlling step further includes the step of controlling the dampers to cause the temperature of the enclosed space to follow the trajectory.

* * * * *